United States Patent [19]

Bradt

[11] Patent Number: 4,763,095

[45] Date of Patent: Aug. 9, 1988

[54] TRANSFORMER WITH CAST INSULATION JACKET

[75] Inventor: Peter Bradt, Ganderkesee, Fed. Rep. of Germany

[73] Assignee: Siemens Aktiengesellschaft, Berlin and Munich, Fed. Rep. of Germany

[21] Appl. No.: 894,781

[22] Filed: Aug. 8, 1986

[30] Foreign Application Priority Data

Sep. 3, 1985 [DE] Fed. Rep. of Germany ..... 3531445

[51] Int. Cl.[4] ..... H01F 27/04

[52] U.S. Cl. ..... 336/96; 264/272.15; 264/272.19; 336/107; 336/198

[58] Field of Search ..... 336/198, 208, 192, 107, 336/105, 96; 264/272.15, 272.19, 275

[56] References Cited

U.S. PATENT DOCUMENTS

| | | | |
|---|---|---|---|
| 2,725,539 | 11/1955 | Merrill | 336/96 |
| 3,525,966 | 8/1970 | Wierzbinski | 336/205 |
| 3,909,759 | 9/1975 | Ouellette et al. | 336/96 X |
| 3,959,760 | 5/1976 | Ouellette et al. | 336/107 X |
| 4,019,167 | 4/1977 | Barker | 336/96 |
| 4,161,776 | 7/1979 | Onoue | 336/107 X |
| 4,408,176 | 10/1983 | Nakamura | 336/96 X |
| 4,514,713 | 4/1985 | Van Dam | 336/107 X |

FOREIGN PATENT DOCUMENTS

| | | | |
|---|---|---|---|
| 1525962 | 4/1968 | France . | |
| 2222002 | 10/1974 | France | 336/96 |
| 2529376 | 12/1983 | France . | |
| 690713 | 6/1965 | Italy | 336/205 |
| 2089764 | 6/1982 | United Kingdom . | |

*Primary Examiner*—Thomas J. Kozma
*Attorney, Agent, or Firm*—Kenyon & Kenyon

[57] ABSTRACT

A compact high-voltage transformer resistant to moisture leaching and acids for airport navigation light systems includes primary and secondary windings wound upon a plastic coil form in turn surrounding a central portion of an iron transformer core. Connector socket members retained with prefixation on the coil form are provided with connector sleeves for receiving external leads, the sleeves being conductively connected to the ends of the primary and secondary windings. The transformer core is spaced from the inner surface of the coil form by means of spacer elements molded onto the inner surface of the coil form whereby a layer of thermoplastic synthetic resin material is injected between the core and the coil form during an injection molding operation. The injection molded jacket is the only insulation jacket provided in the transformer assembly.

7 Claims, 3 Drawing Sheets

TRANSFORMER WITH CAST INSULATION JACKET

BACKGROUND OF THE INVENTION

This invention relates to a transformer assembly including a cast insulation jacket, particularly for use in a below-grade airport navigation light system, and relates further to a method for the manufacture of the transformer assembly. Such transformers, together with associated floodlights, are sunk into airport runways and, accordingly, must be compact, completely water tight and resistant to leaching, acids and salt water in order to ensure reliability of operation.

In a transformer disclosed in U.S. Pat. No. 4,019,167, which transformer has a cast resin jacket and is usable in a airport navigation light system, an iron transformer core, around which primary and secondary coils of the transformer are wound, is encapsulated in a rubber sleeve prior to the casting of the resin jacket. The rubber sleeve serves as an additional buffer to keep thermal tensions and thermal expansions, and other effects of the iron core and coil unit, away from the cast synthetic resin jacket. To connect external electrical leads to the ends of the primary and secondary transformer windings, terminal pins are cast directly into the insulation jacket. The free outer ends of these terminal pins project into funnel-shaped depressions formed in the cast resin insulation jacket. Into the depressions are inserted rubber sockets which receive the external electrical leads and which are provided with plug sleeves mating with the terminal pins in the funnel-shaped depressions in order to operatively connect the external electrical leads to the transformer windings.

An object of the present invention is to provide an improved high-voltage, insulation-jacketed transformer of the above-described type.

Another object of the present invention is to provide such a transformer which is particularly adapted for use in the below-grade airport navigation light systems.

Another, more particular, object of the present invention is to provide such a transformer which is compact and small, watertight and resistive to salt water as well as to leaching and acids.

Another particular object of the present invention is to provide such a transformer which is easy to manufacture.

SUMMARY OF THE INVENTION

A transformer assembly in accordance with the present invention comprises a coil form of synthetic resin material having a substantially rectangular hollow body portion, an iron transformer core having a central portion traversing the hollow body portion of the coil form, a primary winding and a secondary winding both wound about the coil form and a plurality of rubber socket members fixed on the coil form. Each socket member is provided with a connector for receiving a respective external electrical lead, the connector being operatively coupled to a respective winding end of the primary and secondary windings. A plurality of spacer elements are molded on the inner surface of the hollow body portion for spacing the central portion of the core from the inner surface of the coil form to provide an intermediate space or an interspace. Exactly one integral elastic cast resin insulating jacket is injection molded about the coil form, the primary and the secondary windings, the core and at least portions of the socket members. The cast resin insulating jacket has a portion substantially completely occupying the interspace.

In accordance with further features of the present invention, the coil form is provided with flanges in planes transverse to the hollow body portion, mounting means being provided on the flanges for holding the socket members. The mounting means advantageously includes sockets for receiving plugs formed on the socket members.

Pursuant to another feature of the present invention, the hollow body portion has a plurality of corners defined by the inner surface of the hollow body portion, the spacer elements being removed from the corners.

In accordance with one of two alternative features of the invention, the connectors of the socket members each include a plug-in sleeve. In accordance with the other alternative feature, each connector is connected to a respective winding end of the primary and the secondary windings by an insulated cable having one end stripped to expose a conductor, the cable having a jacket vulcanized to the respective socket member.

A method for manufacturing a transformer assembly comprises, in accordance with the present invention, the steps of (a) providing a coil form of synthetic resin material and an iron transformer core, the coil form having a substantially rectangular hollow body portion, (b) disposing the core with respect to the coil form so that the core has a central portion traversing the hollow body portion of the coil form, and (c) spacing the central portion of the core from an inner surface of the coil form to provide an interspace between the central portion and the coil form. The step of spacing is accomplished by the provision of a plurality of spacer elements molded on the inner surface of the hollow body portion. In other steps, a primary winding is wound about the coil form, a secondary winding is wound about the coil form, and a plurality of rubber socket members are fixed on the coil form. A plurality of connectors are disposed in respective socket members for receiving respective external electrical leads.

The connectors are operatively coupled in a further step to respective winding ends of the primary and secondary windings. The coil form, together with the core, the primary winding, the secondary winding and the socket members, are placed into an injection mold and those elements are held in the injection mold by at least one of the socket members. In a final step, thermoplastic synthetic resin is injected into the mold to form exactly one integral elastic cart resin insulating jacket about the coil form, the windings, the core and at least portions of the socket members. The cast resin insulating jacket has a portion substantially completely occupying the interspace between the central portion of the core and the inner surface of the coil form.

Pursuant to another particular feature of the present invention the synthetic resin is injected into the mold in a direction parallel to an axis of the coil form.

A transformer in accordance with the present invention is satisfactorily water tight and resistive to soil, salt water, leaching and acids, even when the inner active part of the transformer, i.e.. the core, the coil form, the windings and the socket members, heats up abnormally. Moreover, the insulation of the transformer assembly is accomplished without additionally and separately buffering the active part. The insulation is achieved by injection molding an elastic resin jacket about the windings and coil form and by injecting the resin into the space between the central portion of the iron core and the inner surface of the coil form, this space being advantageously formed by means of spacer elements on the inner surface of the coil form.

Penetration of moisture along the connecting lines coupled to the external electrical leads is unequivocally prevented in a transformer in accordance with the present invention, owing to the retention of the rubber sockets prefixed on the coil form prior to the injection molding step. The rubber sockets are encompassed with a high sealing pressure by the casting compound, analogously to a press fit, when the insulating jacket cools.

DETAILED DESCRIPTION

Figure 1:
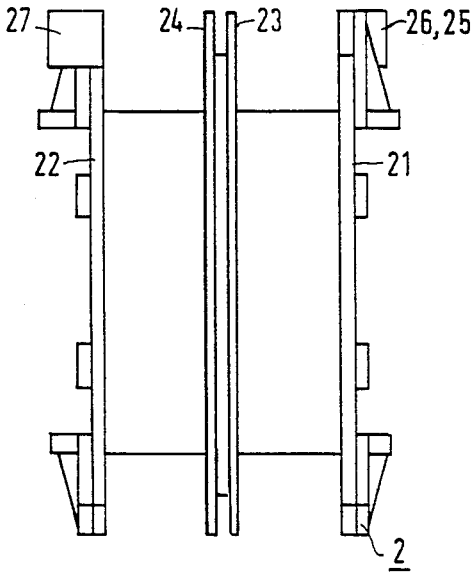
FIG. 1 is a side elevational view of a coil form used in a transformer assembly in accordance with the present invention.
Figure 2:
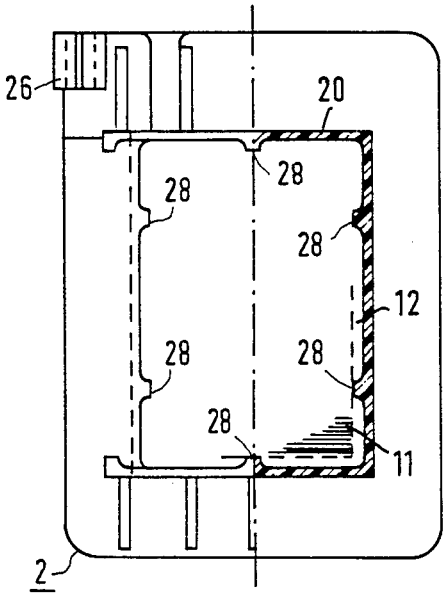
FIG. 2 is partially an axial elevational view of the coil form of FIGS. 1 and 3 and partially a cross-sectional view taken along line II—II in FIG. 3.
Figure 3:
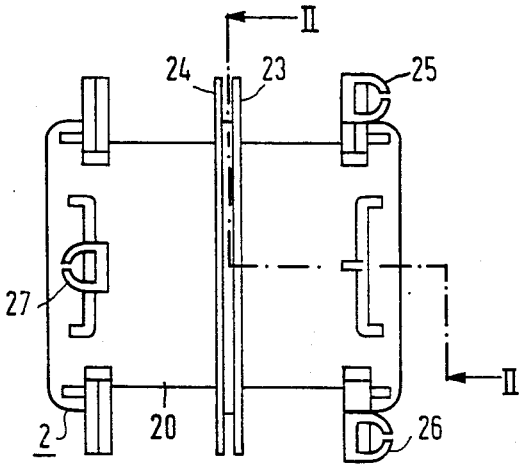
FIG. 3 is a top view of the coil form of FIG. 1.
Figure 5:
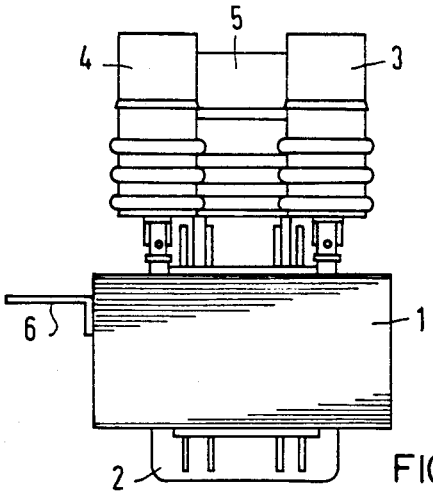
FIG. 5 is an axial elevational view of the coil form of FIGS. 1–3 provided with primary and secondary windings as well as with an iron transformer core and prefixed rubber socket members such as that illustrated in FIG. 4.
Figure 9:
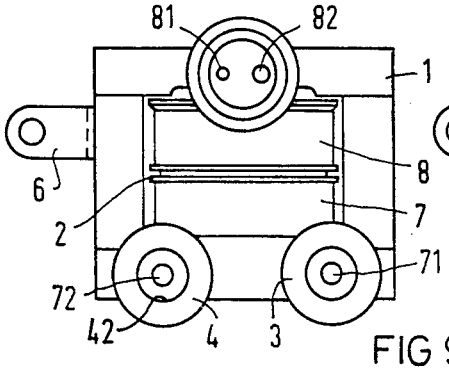
FIG. 9 is a top view of the transformer assembly of FIG. 5.

As illustrated in FIGS. 1–3, a coil form 2 used in a transformer assembly in accordance with the present invention comprises a rectangular hollow body portion 20 provided on an inner surface with a multiplicity of spacer projections 28 removed from the corners of the hollow body portion. The hollow body portion of coil form 2 is further provided on an outer surface with four rectangular or substantially rectangular flanges 21, 22, 23 and 24 disposed in respective transverse planes longitudinally spaced from one another. The outer surface of hollow body portion 20, together with flanges 21 and 23, defines a space for a primary tranformer winding 7 (FIGS. 6 and 9), while the outer surface of hollow body portion 20 and flanges 22 and 24 define a space for a secondary transformer winding 8. Molded to the upper side of flange 21 are a pair of clips 25 and 26 for the prefixed retention of connecting rubber sockets 3 and 4 (FIGS. 5 and 9). Similarly, another retaining clip 27 is molded to the top side of flange 22 for the prefixed retention or holding of a rubber connecting socket 5.

Figure 4:
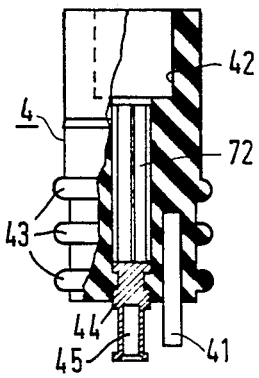
FIG. 4 is a side elevational view, partially in cross-section, of a socket member attachable to the coil form of FIGS. 1–3.

As illustrated in detail in FIG. 4, rubber connecting socket 4 takes the form of a cylinder provided at one end with a cylindrical recess 42 and at an opposite end with three circumferentially extending ribs 43 longitudinally spaced from one another. A connector element in the form of a sleeve is axially disposed in rubber socket member 4 for receiving a conductor or lead of an external electrical cable (not illustrated) having a sheath or jacket partially insertable into recess 42. Sleeve 72 is conductively couplable to an end of primary winding 7 via a coupling element 44 provided with a recess 45 for receiving the winding end. A pin 41 is embedded or cast into rubber socket member 44 at an end thereof opposite recess 44. Pin 41 serves as a plug connection insertable into clip 26 (see FIGS. 3 and 6).

Socket member 3 is structurally identical to socket member 4 (see FIGS. 5, 6 and 9), while socket member 5 is provided with a pair of connectors 81 and 82 preferably in the form of sleeves for receiving the electrically conductive ends of a pair of leads of an external electrical cable. These leads are connected via sleeves 81 and 82 to the winding ends of secondary winding 8.

Upon winding of the primary and secondary windings 7 and 8 about coil form 2 and upon the fixation of rubber socket members 3, 4 and 5 to clips 25, 26 and 27, the ends of primary and secondary windings 7 and 8 are inserted into respective recesses 45 (FIG. 4) of coupling elements 44 of socket members 3, 4 and 5 and subsequently soldered or crimped thereto. The leading end portion of an external electrical cable or a plug connected to the stripped end portion of that electrical cable is plugged into recess 42 and sleeve 72 (FIG. 4) of a respective rubber socket member 3, 4 or 5.

Figure 11:
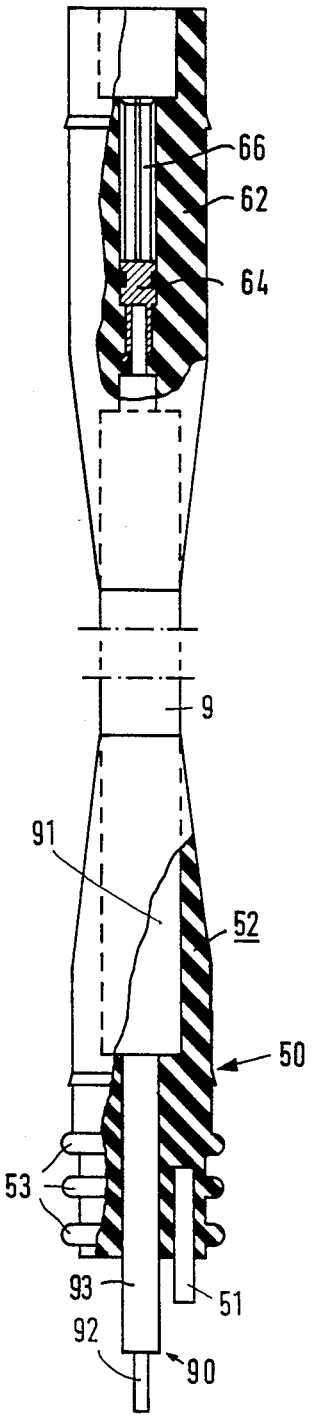
FIG. 11 is a side elevational view, partially in cross-section, of another socket member attachable to the coil form of FIGS. 1–3.

As illustrated in FIG. 11, a rubber socket member 50 utilizable in place of socket member 3 or 4, includes a rubber body portion 52 provided at one end with a plurality of circumferential ribs 53 longitudinally spaced from one another. An electrical cable segment 90 has an insulation jacket 93 vulcanized to rubber body portion 52 and stripped away at a free end to enable the connection of a conductor 92 to an end of the primary winding 7. Cable segment 90 forms a part of a connecting line 9 extending from body portion 52 to an auxiliary body portion 62. Conductor 92 is electrically connected via a coupling element 64 to a connector in the form of a sleeve 66. Sleeve 66 receives a pin of a plug connector at the terminal end of an external electrical cable.

In fabricating a transformer assembly in accordance with the present invention, an iron transformer core one is disposed with respect to coil form 2 so that core 1 has a central portion 11 (see FIG. 2) traversing hollow body portion 20. Central portion 11 of transformer core 1 is spaced from the inner surface of hollow body portion 20 to provide an intermediate space or interspace 12 between the central portion of the core and the hollow body portion 20 of the coil form 2. The spacing is accomplished by means of spacer projections 28. It is to be noted in particular that spacers 28 are removed from the corners of hollow body portion 20 so that the corners, where the magnetic field strength is particularly high, are securely insulated with respect to the surrounding primary and secondary windings 7 and 8.

Generally, core 1 is attached to coil form 2 upon the coiling of windings 7 and 8 about form 2. Socket members 3, 4 and 5 are attached to flanges 21 and 22 via clips 25, 26 and 27 and the ends of windings 7 and 8 are soldered or crimped to the coupling elements 44 of socket members 3, 4 and 5.

Figure 6:
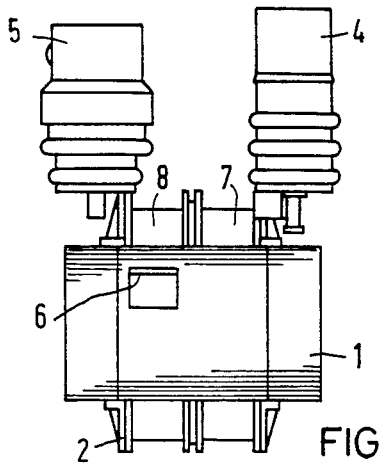
FIG. 6 is a side elevational view of the assembly illustrated in FIG. 5.
Figure 7:
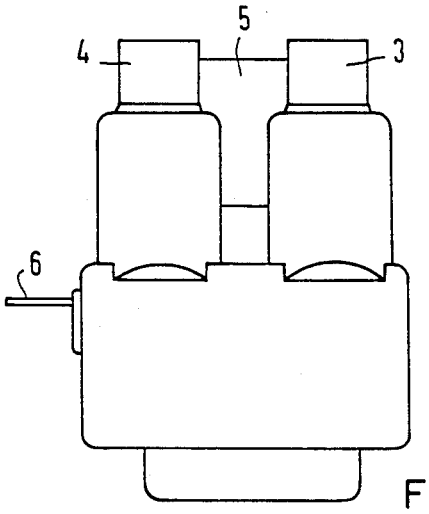
FIG. 7 is an axial elevational view of the transformer assembly of FIGS. 5 and 6 additionally provided with a cast synthetic resin insulation jacket.
Figure 8:
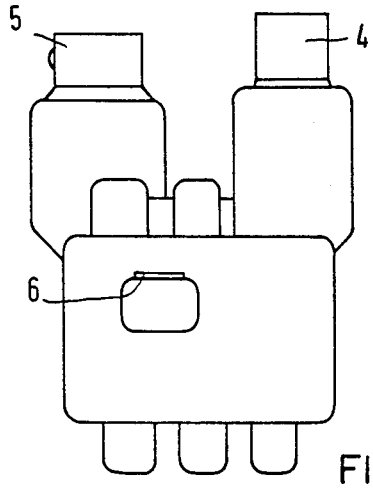
FIG. 8 is a side elevational view of the insulation-jacketed transformer assembly of FIG. 7.
Figure 10:
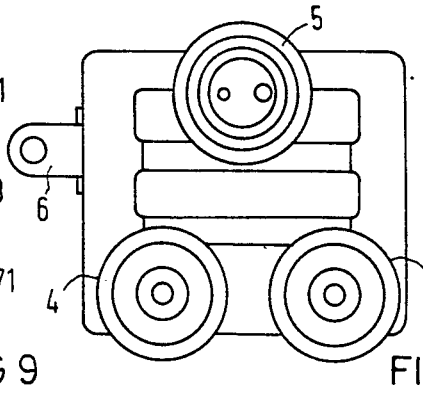
FIG. 10 is a top view of the insulation-jacketed transformer assembly of FIG. 7.

Upon the coiling of primary and secondary windings 7 and 8 about coil form 2, the disposition of core 1 in and about coil form 2 and the attachment of socket members 3, 4 and 5 to coil form 2, a transformer assembly in accordance with the present invention has the unfinished or intermediate form illustrated in FIGS. 5, 6 and 7. Upon the connection of the ends of windings 7 and 8 tc the respective coupling elements of socket members 3, 4 and 5, the entire assembly is placed in an injection mold (not illustrated), the position of the assembly being maintained in the injection mold by means of the socket members. During an injection operation, thermoplastic synthetic resin material is forced into the space 12 between central portion 11 of core 1 and the inner surface of hollow body portion 20 of coil form 2. In addition, the synthetic resin material envelopes coil form 2, primary winding 7, secondary winding 8, core 1 and lower portions of socket members 3, 4 and 5, as illustrated in FIGS. 7, 8 and 10.

As seen in FIGS. 7–10, a grounding strap 6 projecting out of the injection molded insulating jacket shown in those Figures may be welded to the outside of the laminations of core 1.

The use of rubber socket members 3, 4 and 5 to maintain the transformer assembly in the injection mold during the injection operation eliminates the necessity for additional alien spacing means which would cause dangerous, inhomogenous zones in the insulating jacket. The molding compound, injected under high pressure is preferably injected in the direction of the axis of coil form 2 to ensure that the transformer assembly remains in a centered position within the injection mold and thereby ensuring a sufficient thickness of the insulating jacket at all points around the transformer assembly.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A transformer assembly comprising:

a coil form of synthetic resin material, said coil form having a substantially rectangular hollow body portion;

a primary winding would about said coil form;

a secondary winding wound about said coil form;

a plurality of rubber socket members mounted on said coil form by prefixed retention means to selectively, independently maintain and position said coil form in an injection mold;

a plurality of connecting means disposed in respective ones of said socket members for receiving respective external electrical leads, said connecting means being operatively coupled to respective winding ends of said primary and secondary windings;

an iron transformer core having a central portion traversing said hollow body portion of said coil form;

spacing means including a plurality of spacer elements molded on an inner surface of said hollow body portion for spacing said central portion from said inner surface to form an interspace; and exactly one integral cast resin insulating jacket being injection molded about said coil form, said primary winding, said secondary winding, said core and at least portions of said socket members when said rubber socket members independently maintain and position said coil form in said injection mold, said cast resin insulating jacket having a portion substantially completely occupying said interspace, said socket members being substantially permanently fixed to said coil form by said cast resin insulating jacket.

2. The transformer assembly defined in claim 1 wherein said coil form is provided with flanges in planes tranverse to said hollow body portion, further comprising mounting means on said flanges for holding said socket members.

3. The transformer assembly defined in claim 2 wherein said mounting means includes socket means for receiving plugs on said socket members.

4. The transformer assembly defined in claim 2 wherein said hollow body portion has a plurality of corners defined by said inner surface, said spacer elements being removed from said corners.

5. The transformer assembly defined in claim 1 wherein said hollow body portion has a plurality of corners defined by said inner surface, said spacer elements being removed from said corners.

6. The transformer assembly defined in claim 1 wherein each of said connecting means includes a plug-in sleeve disposed in the respective one of said socket members.

7. The transformer assembly defined in claim 1 wherein each of said connecting means is connected to a respective winding end of said primary and secondary windings by an insulated cable having one end stripped to expose a conductor, said cable having a jacket vulcanized to the respective socket member.

* * * * *